9/9/86 XR 4,610,310

United States Patent [19]

Miller et al.

[11] Patent Number: 4,610,310

[45] Date of Patent: Sep. 9, 1986

[54] FIRE PROTECTION SYSTEM

[76] Inventors: Dennis R. Miller, 6125 Haverford Ave., Indianapolis, Ind. 46220; Eugene R. Barnett, 6268 Windsor Dr., Indianapolis, Ind. 46219

[21] Appl. No.: 429,241

[22] Filed: Sep. 30, 1982

[51] Int. Cl.[4] ..... A62C 37/10

[52] U.S. Cl. ..... 169/37; 169/43; 239/1; 239/536; 239/587

[58] Field of Search ..... 239/536, 537, 587, 437, 239/438, 439, 440, 441, 208, DIG. 1; 169/15, 18, 19, 37, 16, 43

[56] References Cited

U.S. PATENT DOCUMENTS

| | | | |
|---|---|---|---|
| 1,629,490 | 5/1927 | Erwin et al. | 169/37 |
| 1,997,404 | 4/1935 | Hamilton | 169/37 |
| 2,025,063 | 12/1935 | Loepsinger | 169/37 X |
| 2,089,304 | 8/1937 | Stein | 239/458 |
| 2,266,321 | 12/1941 | Holder | 239/440 X |
| 2,865,674 | 12/1958 | Jelmeland | 239/208 |
| 2,943,798 | 7/1960 | Rienks | 239/DIG. 1 |
| 3,022,014 | 2/1962 | Young | 239/439 X |
| 3,229,770 | 1/1966 | Harvey | 169/19 |
| 3,421,702 | 1/1969 | O'Brien | 239/587 X |
| 4,221,336 | 9/1980 | Diamond | 239/587 X |

FOREIGN PATENT DOCUMENTS

| | | | |
|---|---|---|---|
| 572752 | 12/1974 | Switzerland | 169/16 |

*Primary Examiner*—Joseph F. Peters, Jr.
*Assistant Examiner*—Scott D. Malpede
*Attorney, Agent, or Firm*—Robert A. Spray

[57] ABSTRACT

A fire protection system, having spaced outlet heads as water spray sources, the outlet heads having sets of outlet nozzles for providing concentric zones of water spray coverage, either 360° or less than 360° to achieve a generally uniform spray coverage for minimization and more effectiveness of water use. The outlets are adjustable as to both droplet size and direction of the spray dispensed; and remote control of actuation of individual outlet nozzles or of sets thereof further minimizes and makes more effective the water use.

15 Claims, 13 Drawing Figures

FIRE PROTECTION SYSTEM

This invention relates to a fire protection system and process of dispensing water fairly evenly and of a controlled droplet size over an area and providing an adequate supply of fluid or water without the usual large amount of overlapping or the dispensing of water in unneeded quantity and in unneeded areas.

In many cases where large amounts of fluid or water are dispensed in unnecessary amounts in some areas, other areas will not have proper amounts available as needed Also, in some cases, the supply of water in unlimited supplies is not available.

This invention also relates to novel dispensing, multi-nozzle sprinkler heads, with adjustable quantity and droplet size features, and directable nozzle features to carry out the necessary fire protection function needed.

Further, the functions of these novel sprinkler heads may be varied to fit almost all applications and protection requirements.

In carrying out the invention in a preferred embodiment, the sprinkler heads are arranged in a spaced pattern, and the dispenser heads are each provided with a plurality of sets of outlet nozzles, each of the sets themselves having a plurality of the nozzles; and the sets of outlets being of a nature such as to dispense water in not only 360° areas but in concentric zones. Further, the outlets of each set are arranged and directed such as to avoid substantial overlapping in any area which is common to a zone to which would receive water dispensed from another dispenser head, by providing that the zones of water coverage from certain of the heads are less than 360° in extent.

The invention thus provides a thoroughness of fire protection coverage, by substantially uniform amounts of water. The concepts are particularly advantageous in situations where the inlet pipes are only of temporary nature; for the thoroughness of sprinkler dispensing and coverage of a large area is such as to minimize the number of temporary standpipes or the like which would be needed, although the concepts are not limited to such situations or installations.

In searches independently run after the invention was made, the following references were cited:

| U.S. Pat. No. | Patentee | Issued |
|---|---|---|
| 3,918,645 | Mohler | November 11, 1975 |
| 4,091,873 | Werner | May 30, 1978 |
| 2,025,063 | Loepsinger | December 24, 1935 |
| 2,235,258 | Jones | March 18, 1941 |
| 1,629,490 | Erwin et al. | May 24, 1927 |
| 784,461 | Williams | March 7, 1905 |
| 3,698,481 | Livingston | October 17, 1972 |
| 561,311 | Gray | June 2, 1896 |
| 1,823,635 | Williams | September 15, 1931 |
| 1,475,052 | Collins | November 20, 1923 |
| 3,837,405 | Huddle | September 24, 1974 |

Further, another reference was learned, that being U.S. Pat. No. 2,089,304, issued to P. Stein Aug. 10, 1937.

Of these, however, only the Livingston patent seems to be of a type where sprinkler coverage is considered to be other than in the one circular area about the dispenser head, but it seems to consider only angular zones; and has much overlapping in spite of such consideration.

The Williams U.S. patent application Ser. No. 784,461 presumably would dispense in four directions, plus a vertically-upright direction; but there seems nothing which would provide or suggest concentricity of 360° zones or their limitation as to certain-outlet heads to minimize overlapping.

The Williams U.S. Pat. No. 1,823,635 patent and the Erwin patent have different sets of outlets, but do not seem to show any concept of minimizing of overlapping by different outlet heads nor any limitation of dispensed zones, even if the sets of outlets would give a concentricity of dispensate.

Thus it seems that the prior art in this field seems to emphasize the inventive novelty of the concepts rather than detract therefrom, for even where overlap-minimization of dispensing from the various outlet heads is considered, the prior art shown by the patentees and by all others ever since has failed to conceive the advantageous concepts of this overall invention.

The above description is of somewhat introductory and generalized form. More particular details, concepts, and features are set forth in the following and more detailed description of illustrative embodiments, taken in conjunction with the accompanying drawings, which are of somewhat schematic and diagrammatic nature, and in which.

Figure 1:
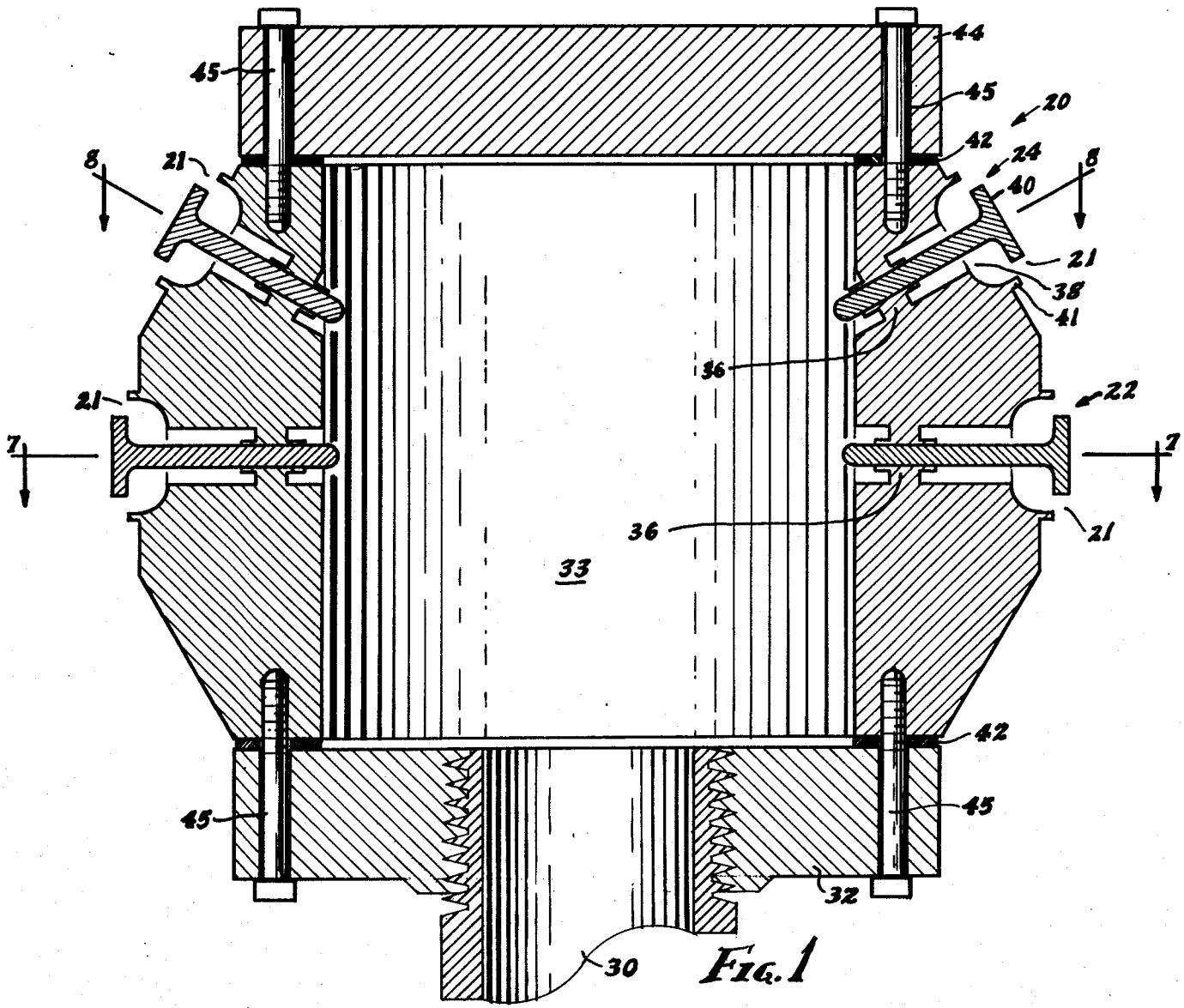
FIG. 1 is a vertical cross-sectional view of one of the dispenser heads according to one embodiment, having eight outlet nozzles in the central set and four nozzles of the upper set, the outlet nozzles all being of an adjustable-stem type permitting adjustment of droplet size.
Figure 3:
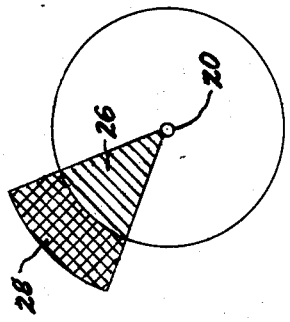
FIG. 3 is a plan view of the water coverage zones of water coverage by a dispenser head of FIG. 1, but with the head set or adjusted to dispense from only one of the outlet nozzles of the central set and only the vertically-corresponding outlet nozzle of the upper set.
Figure 4:
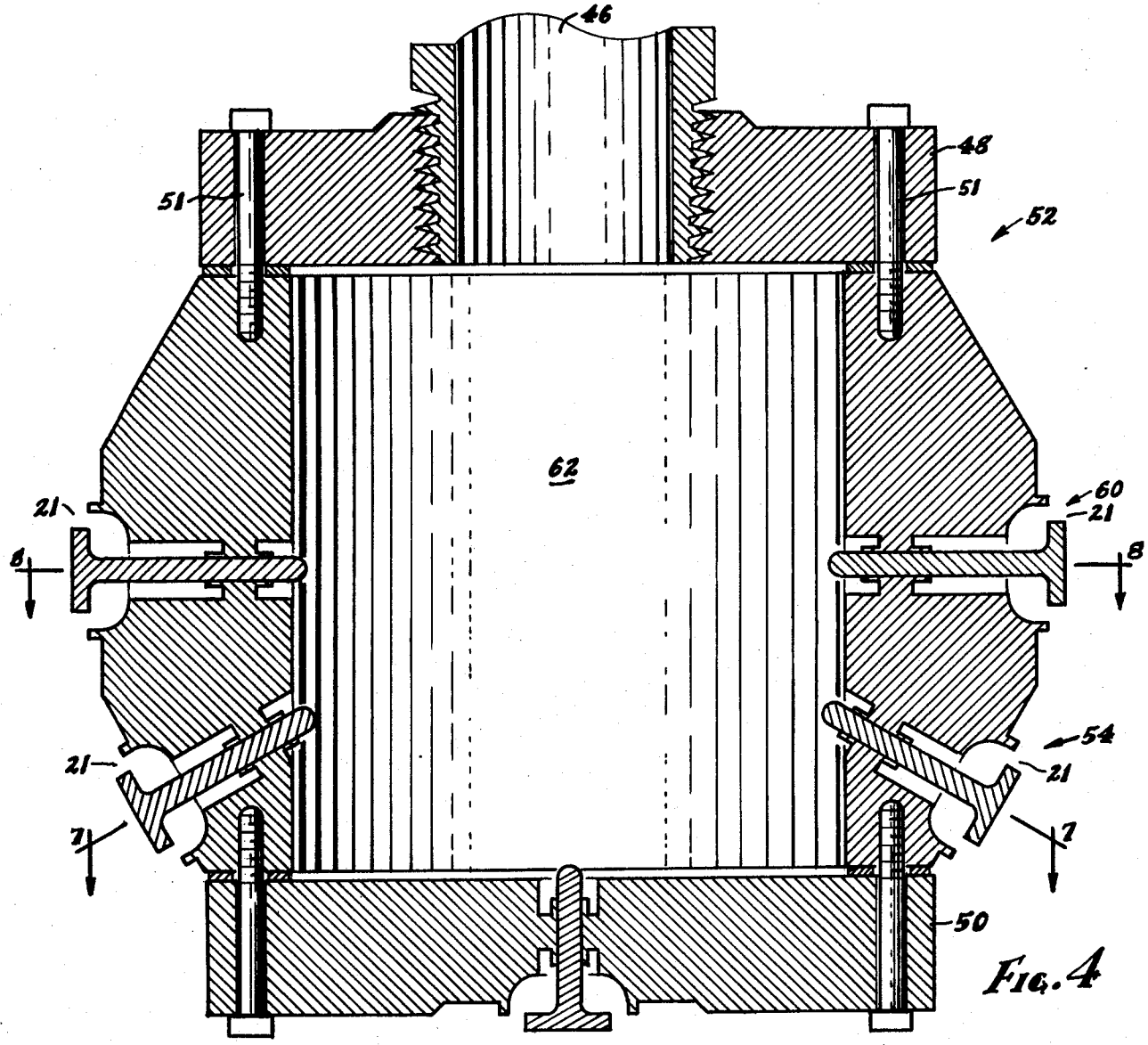
FIG. 4 is a vertical cross-sectional view of one of the dispenser heads of another embodiment, having four outlet nozzles in the central set, eight outlet nozzles in an intermediately lower set, and a single outlet nozzle in the bottom end plate.
Figure 6:
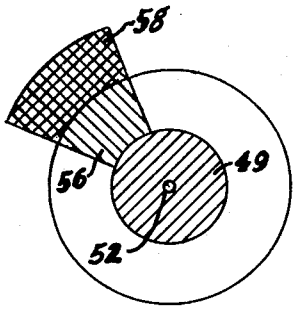
Figure 7:
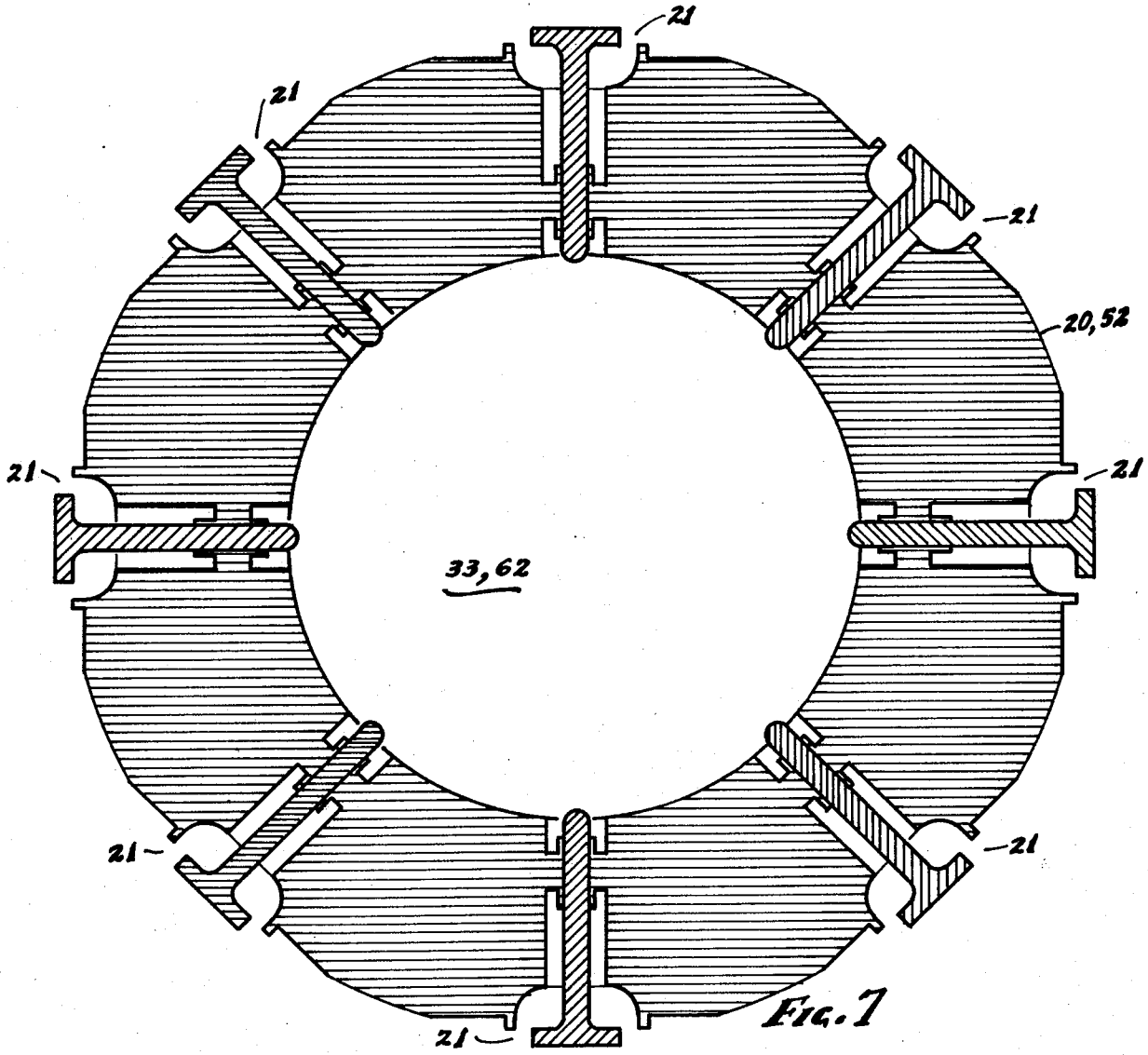
Figure 8:
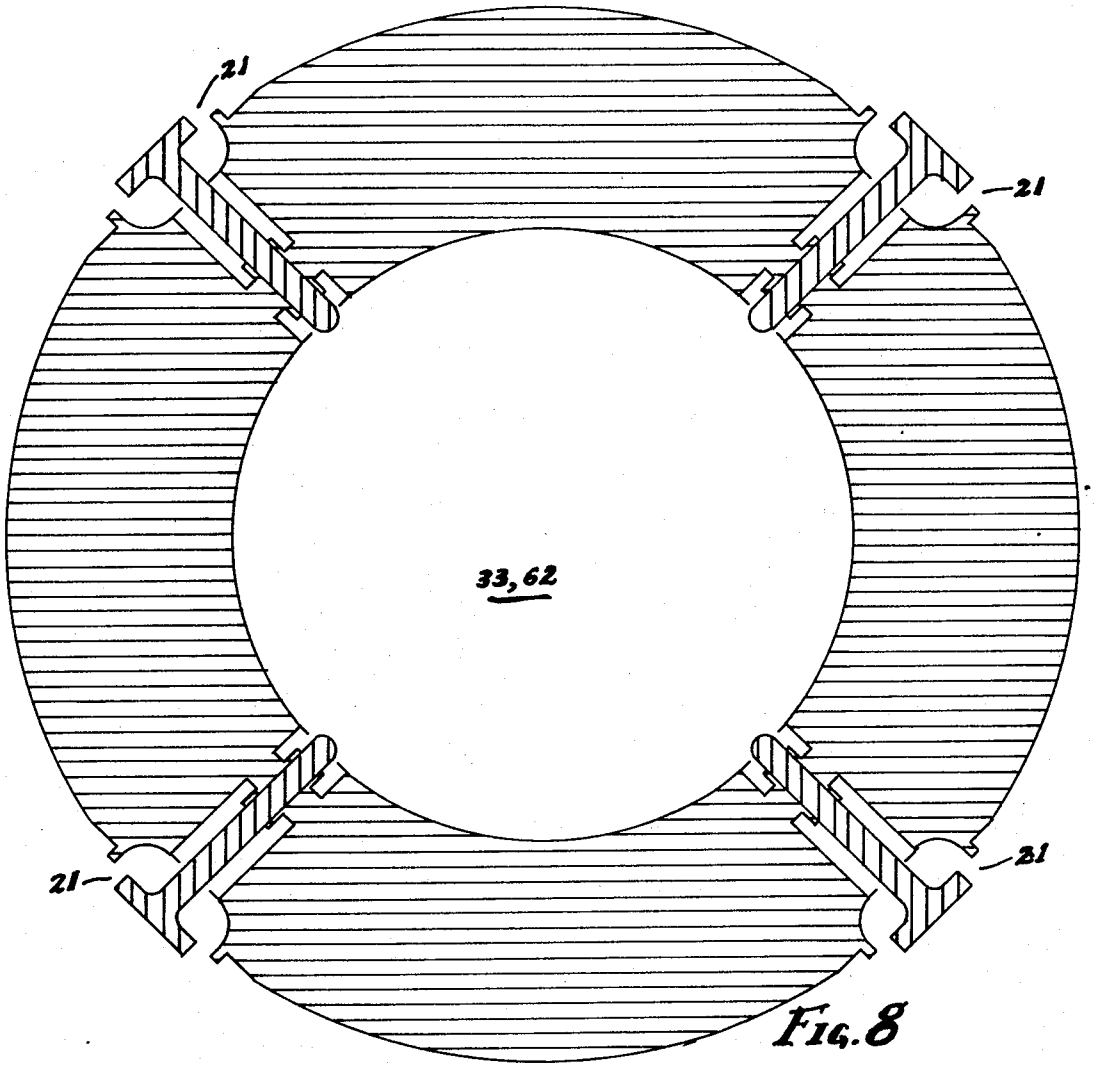
Figure 9:
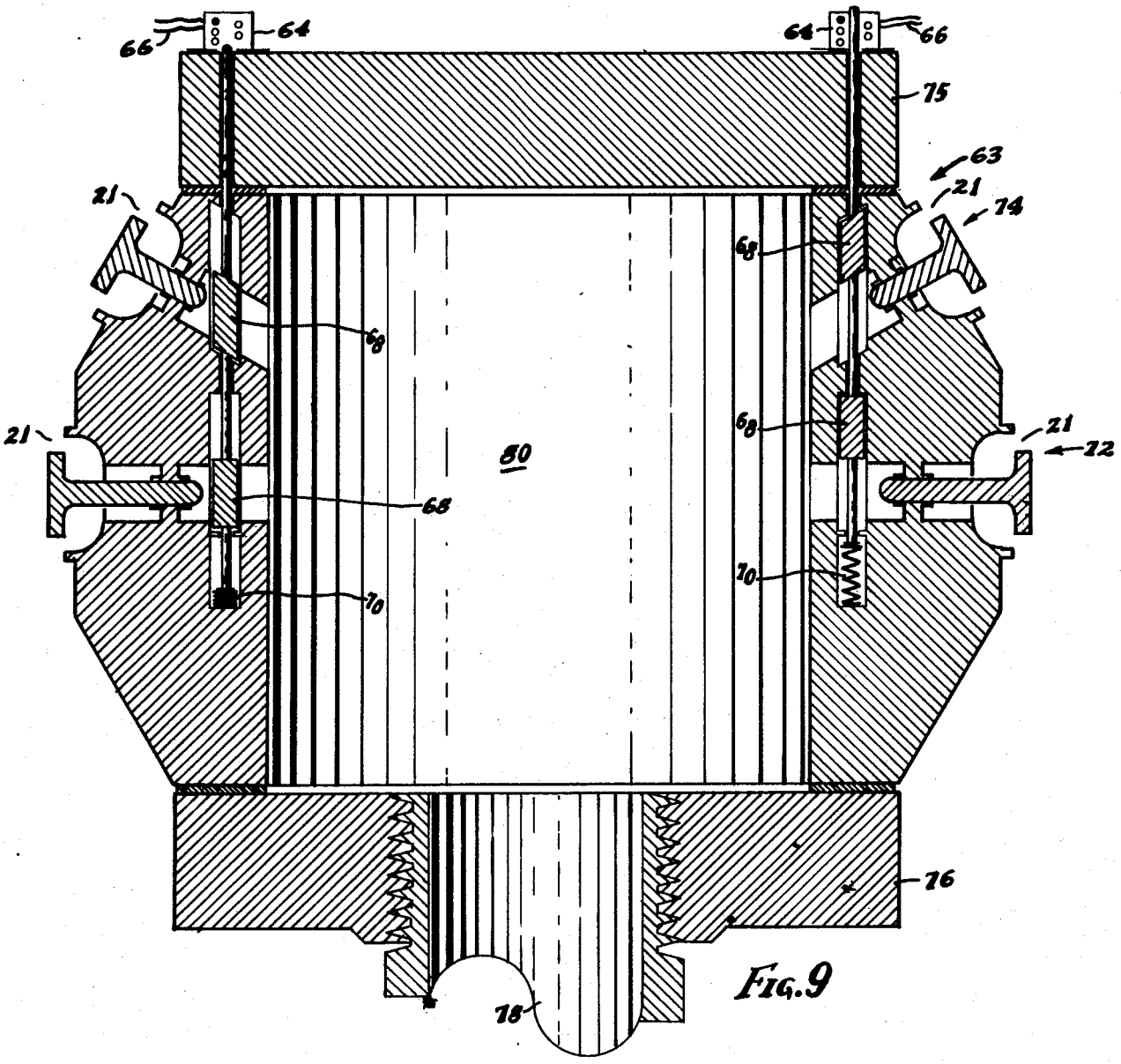
Figure 10:
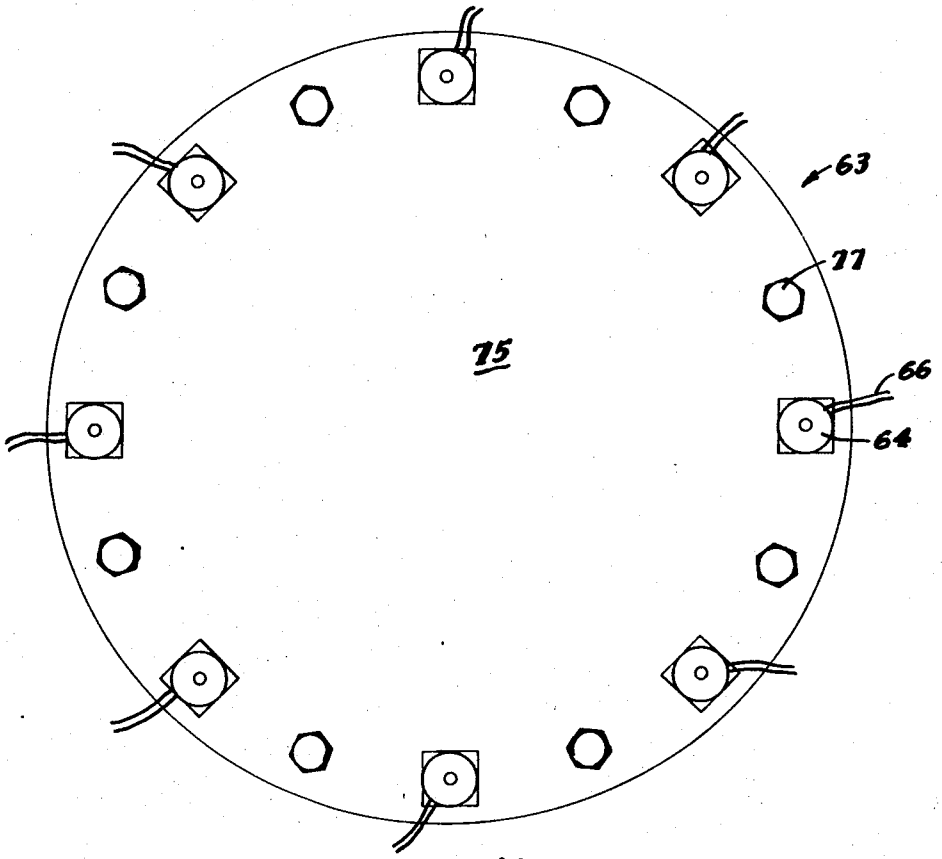
Figure 11:
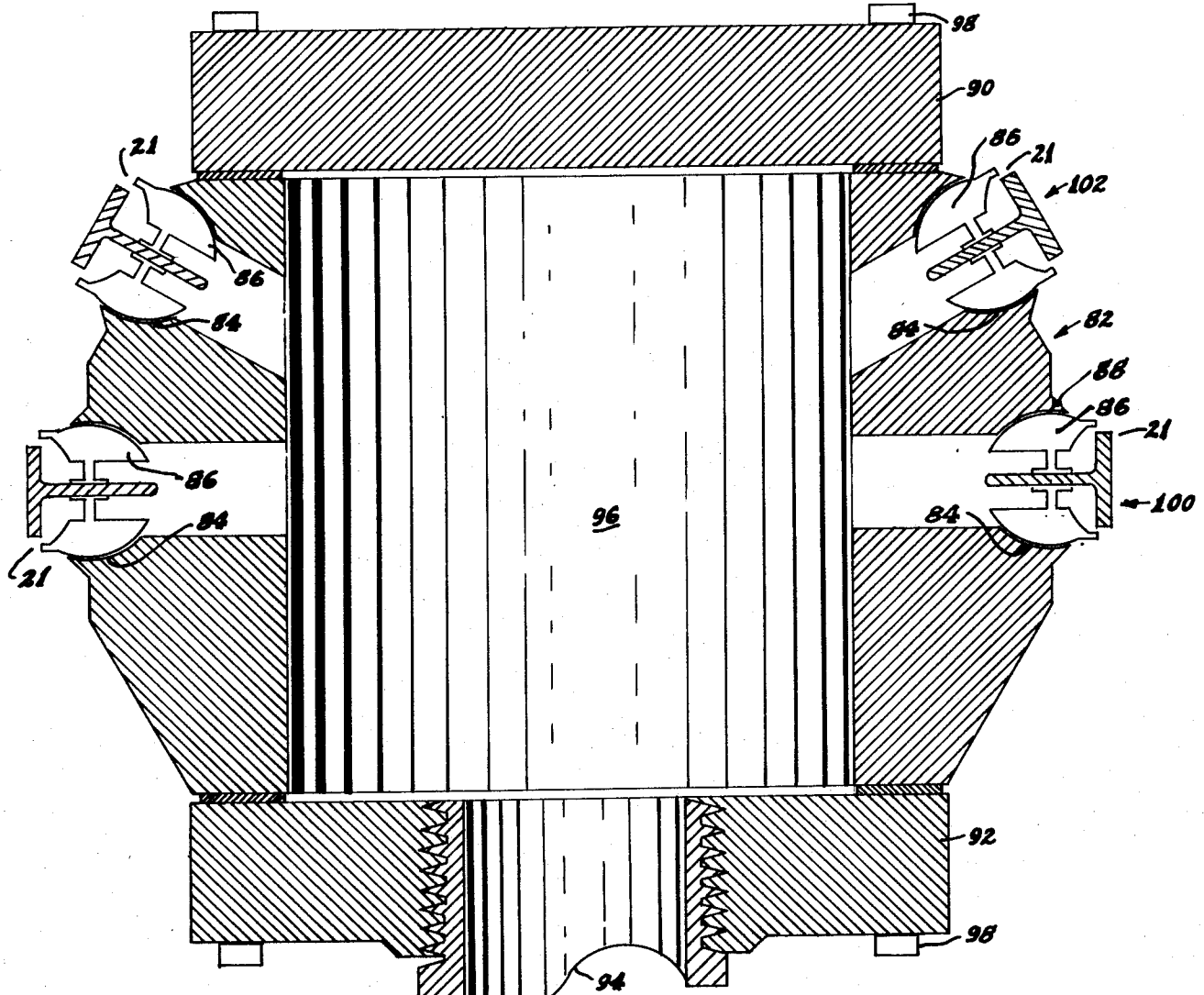

FIG. 6, similar to FIG. 3, is a plan view of the water coverage by a dispenser head of FIG. 4, and with the head set or adjusted to dispense from the bottom outlet nozzle but from only one of the outlet nozzles of the intermediate lower set, and only the vertically-corresponding outlet nozzle of the central set;

FIG. 7 is a cross-sectional view of a set of eight outlet nozzles, as would be generally indicated by Section-line 7—7 of FIGS. 1 and 4;

FIG. 8 is a cross-sectional view of a set of four outlet nozzles, as would be generally indicated by Section-line 8—8 of FIGS. 1 and 4;

FIG. 9 is a vertical cross-sectional view of a dispenser head of another embodiment, similar to FIG. 1 and having eight outlet nozzles in the central set and four outlet nozzles in the upper set, but this embodiment providing solenoid-controlled valves for each of the outlet nozzles;

FIG. 10 is a plan view of a solenoid-controlled dispenser head according to FIG. 9;

FIG. 11 is an axial cross-sectional.view of a dispenser head according to another embodiment, which provides cylindrical or spherical seating surface of an outlet member to provide direction-adjustment of the dispensate.

Figure 12:
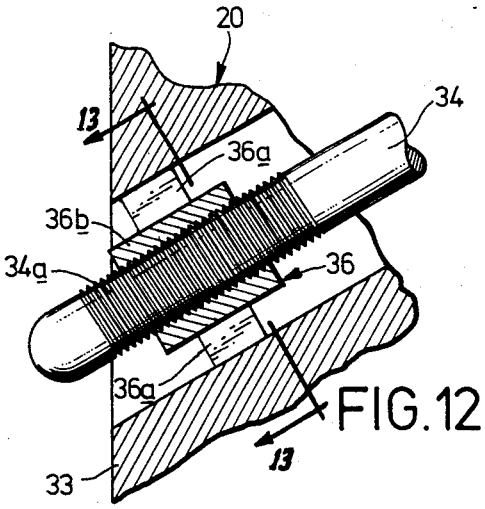
Figure 13:
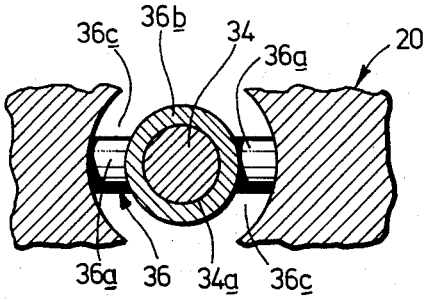

FIG. 12 is a cross-sectional view of a single valve within a dispenser head;

FIG. 13 is a cross-seconal view of the valve as indicated by section-line 13—13 of FIG. 12.

As shown in the drawings, the present invention provides novel and advantageous concepts for fire-protection sprinkler systems, the concepts relating to water-dispenser heads, an array of such heads, and to a process of water-dispensing, to provide the zone-type sprinkler coverage emphasized herein.

In all cases, i.e., whether considering the concepts from the standpoint of apparatus or process, it is significant to realize that the fire-protection desire is to cover an area larger than would be covered by water dispensed from a single dispenser head; and all the types of dispenser heads of the various embodiments are preferably to be considered in that respect as to details of their functioning.

As shown in FIG. 1, a dispenser head 20 is provided to have a plurality of sets of outlet nozzles 21; and in the FIG. 1 embodiment there is a central set 22 of eight nozzles 21 and an upwardly-directed set 24 of four of them. Each of the sets 22–24 is provided to have a plurality of outlets 21; and as shown in FIGS. 2 and 3, the sets 22–24 of outlets 21 are of a nature such as to dispense water in concentric zones.

More particularly, the outlets 21 of each set 22–24 are arranged and directed such as to restrict dispensing circumferentially so that the zone covered by the water dispensed from the respective set is 360° in circumferential extent or less than 360° so as to exclude dispensing into areas of a zone to which water is being dispensed from another of such heads.

Figure 2:
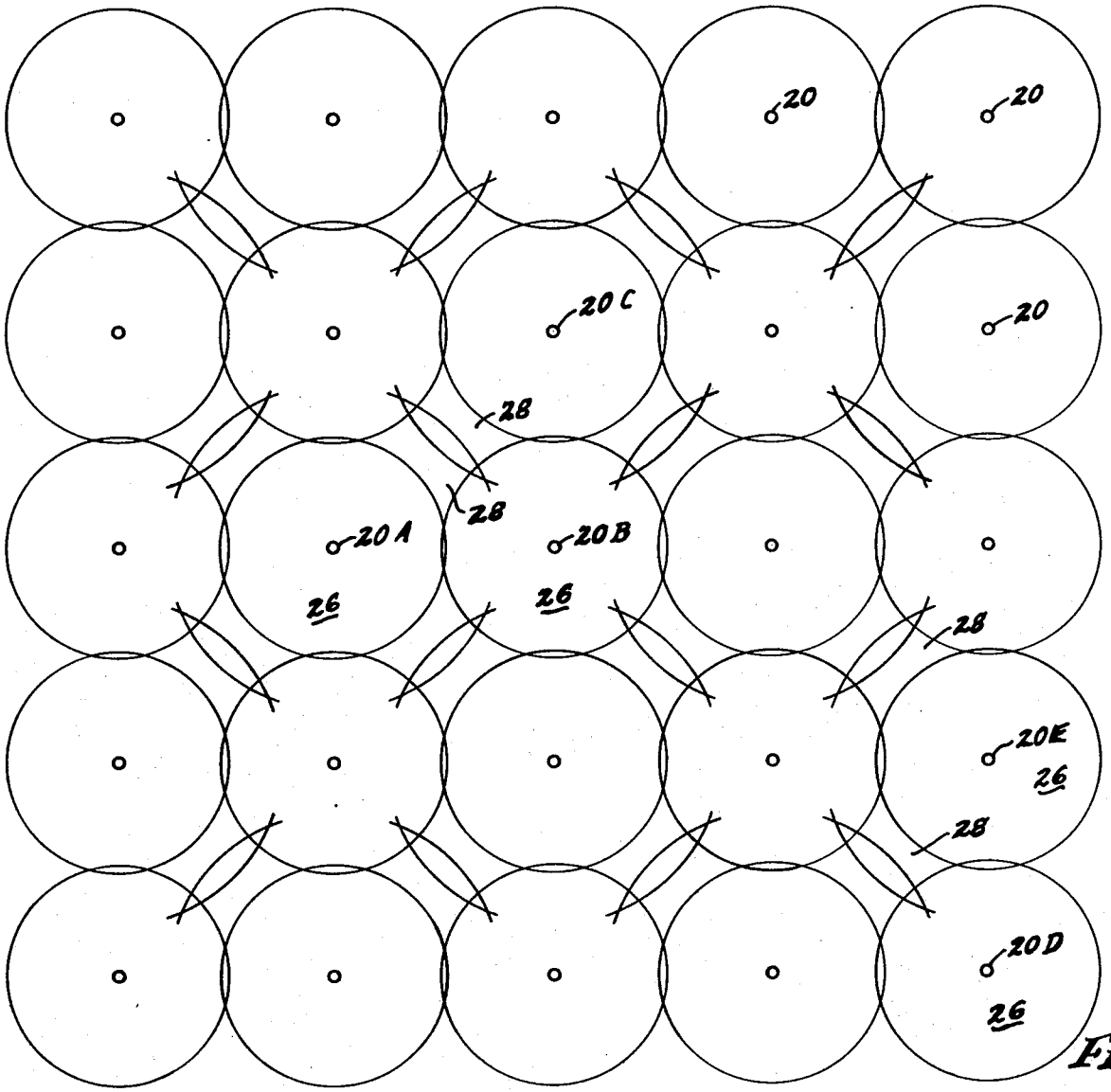
FIG. 2 is a plan view of large area receiving the process of fire protection by an installation of twenty five of the dispenser heads of FIG. 1, and illustrating zones of water coverage.

That is, observing the dispersion-pattern of FIG. 2, a head 20 "A" which is adjacent the central head 20 "B" of the array is set to dispense from all eight outlets 21 of the central set 22, and all four outlets 21 of the upper set 24, those four being spaced on 90° centers, vertically aligned with every other outlet 21 of the central set 22, and each outlet 21 of both sets 22–24 being effective to yield a dispersion zone of about 45°.

In such a FIG. 2 area, with the head units 20 in spaced relationship in perpendicular rows, the inner zone 26 about each head 20 is dispensed by the respective heads' lower set 22 of eight nozzles 21; and all the zones 26 are adjacent in their perpendicular rows, but there are generally square-shaped zones outside of the zones 26 and at 45° to the rows of heads 20, each half of such square-shaped zones being indicated by reference numeral 28.

For dispensing to the zones 28, the head units 20 are positioned so that the four nozzles 21 of the upper set 24 are at 45° to the cardinal directions, thus each nozzle 21 of that upper set 24 dispenses to a respective area 28.

Another head 20 "C" adjacent the central head 20 "B" also dispenses like that as just described for the head 20 "A".

The central head 20 "B" is set differently; i.e., either no upper set 24 of nozzles 21 is provided for the central head 20 "B", or if provided are turned off; for all of the generally square-shaped areas (two portions 28) on 45° centers from the central head 20 "B" are shown as serviced fully by adjacent heads 20 although the central head 20 "B" does dispense through its lower set 22 of nozzles 21 to achieve the full 360° of its inner zone 26.

Likewise observing FIG. 2, it will be noted that the outer-row heads 20 are provided to give particular dispensing, i.e., the extreme corner heads, e.g., 20 "D" are set to dispense to only their concentric inner zones 26 (by nozzle-set 22) with no dispensing from any of what would be the four nozzles of an upper set 24, whereas the next-adjacent head 20 "E" will be set to provide full dispensing to the 360° inner zone 26 from all eight outlets 21 of set 22, but, to dispense to the two areas 28, from only two of the outlets 21 of the upper set 24.

Some overlapping of zones will inevitably occur, due to inevitable differences in nozzles 21 or their adjustment, or because the areas 28 are not precisely half-square rectangles; and some differences in the amount of water coverage will occur. Yet there will be a substantial uniformity of coverage of the entire area.

The water supply to the head units 20 is by a standpipe 30 which through the bottom end plate 32 communicates water to the hollow core 33 of the head 20.

The nozzles 21 are desirably comprised of a valve 34 which is threaded into a holding bridge 36 to provide an in-and-out adjusted setting of nozzle opening 38, the water coming out through opening 38 and being then regulated as to droplet size by being squeezed between the valve-head 40 and an adjacent circular rim or nozzle fluid divider 41 exteriorly of the head body 20.

The bridge 36 of FIG. 1 (and its counterpart in FIGS. 4, 7, 8, 9 and 11) is shown more clearly in the enlarged detail views shown as FIGS. 12 and 13 as not a fully-extending disc, but is just a bridge-like member having supporting legs 36*a* which carry a female-threaded central body 36*b*; and the bridge legs 36*a* permit water to flow through the spaces 36*c* which exist between the legs 36*a*, from the body core 33 to the nozzle opening 38. The said adjustment as to valve-setting is provided by the threads 34*a* on the valve-stem 34, those threads 34*a* providing the threaded carry of the valve 34 by the holding bridge 36, for the in-and-out adjustment of valve 34.

Gaskets 42 are shown between the head body 20 and its respective bottom end plate 32 and top end plate 44; and bolts 45 connect both the bottom end plate 32 and the top end plate 44 to the head 20.

FIG. 3 illustrates the 45° spread of each outlet 21 of each of the nozzle sets 22–24 of FIG. 1.

FIG. 4 shows a different embodiment of outlet head, particularly useful if the water supply line 46 is coming from above, through the top end plate 48; and in this unit, the inner circle zone 49 (FIG. 5 pattern) of dispensate comes from a bottom nozzle outlet 21 located on the bottom end plate 50, bolts 51 connecting both end plates 48 and 50 to the head. The circle 49 is 360°.

Figure 5:
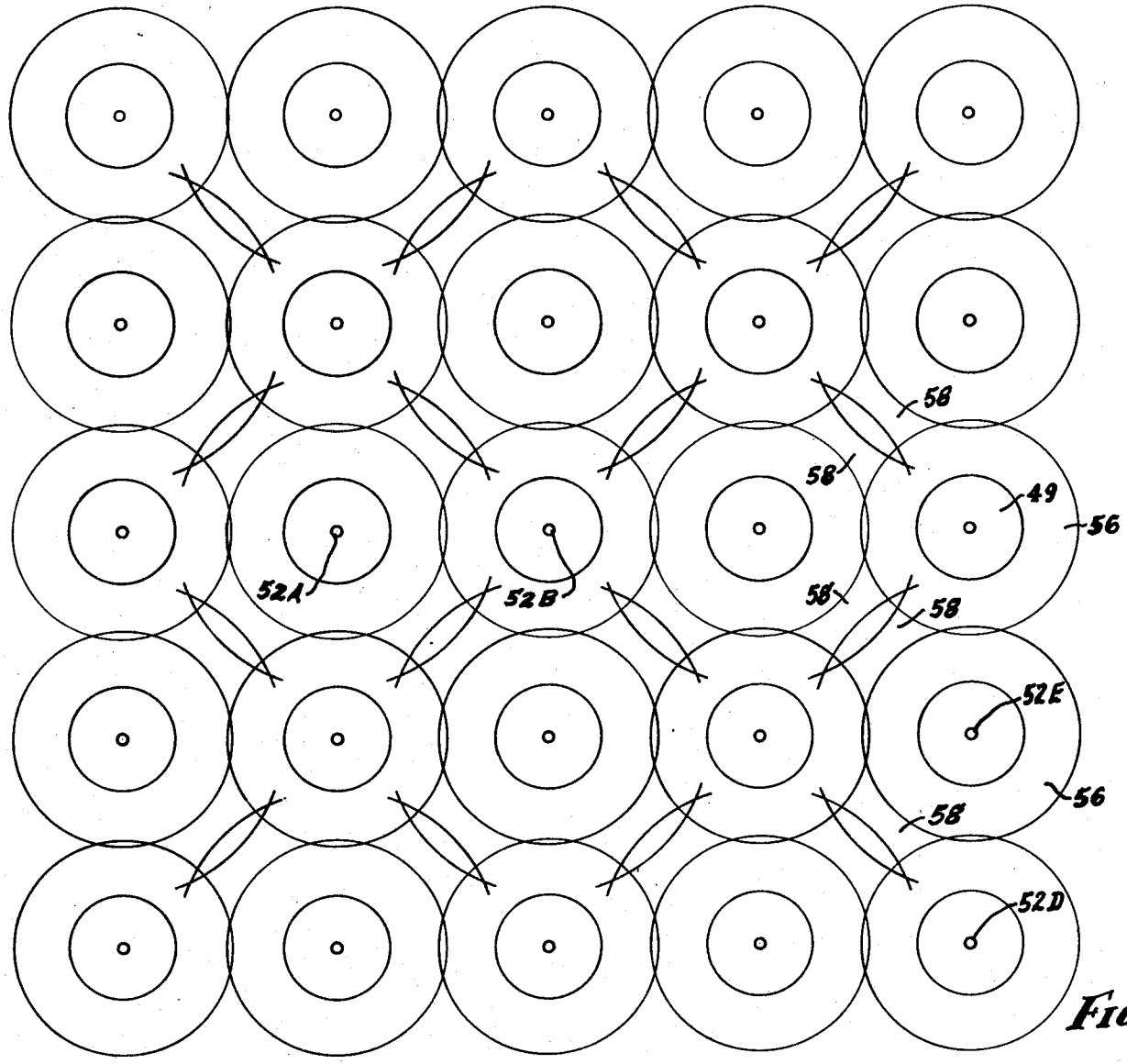
FIG. 5 is a plan view of a large area, similar to FIG. 2, but receiving the process of fire protection by an installation of twenty five of the dispenser heads according to the embodiment of FIG. 4.

In this FIG. 4 embodiment, the head 52 is shown with an intermediate set 54 of eight nozzles 21, which as per FIG. 5 dispense to a 360° zone 56 concentric about the inner zone 49.

The next outer concentric zone 58 of dispensate of head 52 of FIG. 4 are the half-squares 58 of FIG. 5, which are dispensed by the four 90°-spaced central set 60 of nozzles 21 to correspond to the half-square zones 28 of FIG. 2; and like the process there shown, the process shown in FIG. 5 illustrates the use of less than 360° for the outer concentric zone 58 so as to not overlap areas being covered by another outlet 21.

Thus, as in the FIG. 2 process, the head 52 "A" which is adjacent central head 52 "B" is set to dispense from all its four outlets 21 of its central set 60, and all eight of its intermediate set 54, as well as its bottom single outlet 21. Further, as in the FIG. 2 process, certain of the heads 52 are made to dispense other zones of less than 360°, such as the head 52 "D" which dispenses nothing at all from its central set 60, whereas head 52 "E" dispenses from only two of its nozzles of the central set 60.

The head 50 is shown with a hollow core 62, which communicates the supply line 46 with all its outlets.

FIG. 6, as does FIG. 2 for the head 20 of FIG. 1, illustrates the coverage by the head 52 when set to dispense from only one outlet 21 of its set 54 (sector 56) and one from its set 60 (sector 58) as well as the single bottom outlet which provides the circular zone 49.

Remote control actuation of the outlet nozzles 21 of an outlet head 63 is shown in FIGS. 9 and 10. As there shown, solenoids 64 powered by electric circuitry 66 actuate valve members 68, the valves 68 being biased to open position by springs 70, the valves 68 being shown here as of normally-open type closable by electrical actuation of the respective solenoids 64.

The solenoid control of the embodiment of FIGS. 9 and 10 is desirably provided for individual outlet nozzles 21 as well as for the sets of eight nozzles 21 of its central set 72 and the four nozzles of its upper set 74. The head unit 63 of FIG. 9, with its top end plate 75, bottom end plate 76, and its platebolts 77, water inlet pipe 78 which supplies water to the head-core 80, is like the embodiment shown in FIGS. 1, 2, and 3, except for the solenoid control feature of FIGS. 9 and 10.

Directional control of the dispensed spray of water droplets from the outlet heads is shown in FIG. 11. As there shown the head 82 provides a seating base 84 for a second body member 86, and at least one of the seating base 84 and second body member 86 (here both) is provided to have a generally spherical or cylindrical surface; and it and the other of base 84 and body member 86 sealingly but movably engage one another for permitting directional adjustment of the dispensed spray, for the second body member 86 carries the outlet nozzle 21. A set screw 88 maintains whatever directional adjustment is desired.

Except as to the spray-directability feature, the embodiment of FIG. 11 may be like that of FIG. 1, the head of FIG. 11 being shown with a top end plate 90, bottom end plate 92 which is fastened to a water inlet line 94 for delivering water to the head core 96, with bolts 98 holding the end plates 90 and 92 onto the head body 82; and for providing the concentric areas of sprinkler dispensing, the nozzle outlets 21 are provided as eight in a central set 100 and four in an upper set 102.

As herein set forth, the inventive concepts advantageously provide an overall fire protection system or installation having advantages over others; and the concepts may be considered as each and all of improved outlet heads, a system or installation in the sense of a whole array of such heads, or a process, all of these providing advantages including although not limited to the dispensing into concentric zones of 360° or less than 360° to achieve the generally uniform spray pattern herein discussed.

The overall and individual concepts, considered as a process provide the procedures for the dispensing of the water sprays such as to provide a plurality of concentric zones of water coverage from each of the sources, and from a plurality of circumferentially-extending positions at each source for dispensing to each of said zones in a manner for achieving substantially uniform water coverage throughout each of said zones; the dispensing from the sources is also such as to avoid substantial overlapping in any area which is common to a zone of more than one source, by providing that the zones of water coverage from certain of the sources are less than 360° in extent so as to exclude dispensing into areas of a zone into which water is being dispensed from another source.

It is thus seen that outlet heads, the system, and the process, according to the inventive concepts, provide desired and advantageous concepts, yielding several advantages.

Accordingly, it will thus be seen from the foregoing description of the invention according to these illustrative embodiments, considered with the accompanying drawings, that the present invention provides new and useful concepts of a sprinkler system for fire protection, from various standpoints such as pointed out herein, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown. For example, the dispensed material is simply called "water" in the general sense as referring to any fire-extinguishing fluid. Also, the concepts are not to be considered as limited to the particular angles of position shown for the outlet nozzles 21, the angles being shown in the illustrative drawings for illustrating the concept of providing the zones of sprinkler coverage from the nozzle sets.

What is claimed is:

1. A mult-nozzled dispenser head for a fire protection system to cover an area larger than would be covered by water dispensed from a single nozzle dispenser head, comprising:

the multi-nozzled dispenser head being provided to have a pluraltity of sets of outlets, and each of the nozzles being provided with adjustable means to change the water droplet size, each of the sets being provided to have a plurality of outlets, the sets of outlets being of a nature such as to dispense water in concentric zones, a lower one of the sets of outlets being generally horizontally directed, and an upper one of the sets of outlets being upwardly directed, the lower set of outlets being arranged and directed so as to dispense water in a pattern substantially 360° in circumferential extent, and the upper set of outlets being arranged and directed and of a quantity such as to restrict dispensing circumferentially so that the zone covered by the water dispensed from the respective upper set of outlets is a selected amount less than 360° so as to exclude dispensing into areas of a zone to which water is being dispensed from another of such heads, the adjustability of droplet size, in combination with the optional less than 360° extent of water dispensing from any nozzle-head, combining to achieve safety protection against different fire-hazard situations by different droplet sizes in various zones of coverage, from the same multi-nozzled dispenser head.

2. The invention as set forth in claim 1 in a combination in which the outlets are provided to be adjustable with respect to direction of dispensing.

3. The invention as set forth in claim 1 in a combination in which the outlets are provided to be adjustable with respect to both direction of dispensing and as to droplet size.

4. The invention as set forth in claim 1 in a combination in which the outlets are each provided with a valve means for blocking the dispensing of water out the respective outlets, and there being solenoid means provided for controlling each of the valve means, thereby achieving a selection of outlets from which the water is to be dispensed.

5. A multi-nozzled dispenser head for a fire protection system to cover an area larger than would be covered by water dispensed from a single nozzle dispenser head, comprising:

the multi-nozzled dispenser head being provided to have a plurality of sets of outlets, and each of the nozzles being provided with adjustable means to change the water droplet size, each of the sets being provided to have a plurality of outlets, the sets of outlets being of a nature such as to dispense water in concentric zones, a lower one of the sets of outlets being generally horizontally directed, and an upper one of the sets of outlets being upwardly directed, the lower set of outlets being arranged and directed so as to dispense water in a pattern substantially 360° in circumferential extent, and the upper set of outlets being arranged and directed such as to restrict dispensing circumferentially so that the zone covered by the water dispensed from the respective upper set of outlets is a selected amount less than 360° so as to exclude dispensed into areas of a zone to which water is being from another of such heads, the adjustability of droplet size, in combination with the optional less than 360° extent of water dispensing from any nozzle-head, combining to achieve safety protection against different fire-hazard situations by different droplet sizes in various zones of coverage, from the same multi-nozzled dispenser head, in a combination in which the multi-nozzled dispenser head is provided with an end plate for each and thereof, one of said end plated provided with inlet means by which water is supplied to the interior of the multi-nozzle dispenser head, the end plates and the said dispenser head being provided with co-operative connection means, the connection means being of a correspondency as to both ends of the multi-nozzled dispenser head and to both end plates to provide the interchangable mounting of either end plate to each end of the multi-nozzled dispenser head to permit the said dispenser head to be installed selectively with either head facing the associated supply line for communication with the inlet means.

6. Apparatus for the dispensing of water to provide fire protection to an area larger than would be covered by water dispensed from a single source, comprising:

a plurality of multi-nozzled dispenser heads;

supply means for supplying water to the multi-nozzled dispenser heads;

the multi-nozzled dispenser heads being supported in spaced relationship;

the multi-nozzled dispenser heads each having a plurality of sets of outlets, each of the sets having a plurality of outlets, at least one of which sets dispenses in a substantially 360° area;

the sets of outlets being of a nature such as to dispense water in concentric zones;

and the outlets of each set being arranged and directed and of a quantity such as to avoid substantial overlapping in any area which is common to a zone which would receive water dispensed from more than one of the multi-nozzled dispenser heads, by providing that the dispensing from certain sets of outlets is less than 360° thereby providing that the zones of water coverage from certain of the multi-nozzled dispenser heads are less than 360° in extent so as to exclude dispensing into areas of the zone to which water is being dispensed thereto from another of the heads.

7. The invention as set forth in claim 6 in a combination in which each of the dispenser heads comprises a nozzle assembly, including a base member, and a second member, at least one of the base member and second member having a generally spherical surface to which the other member sealingly engages irrespective of the particular relative orientation of the two members as accommodated by the spherical surface, the members being relatively movable to achieve the desired direction of dispensate outwardly through the second member, the second member carrying a valve having a valve-head, the valve-head providing a means for dividing portions of the stream being dispensed, and the valve being threadedly connected to the second member, providing axial adjustability of the valve and valve-head by which droplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) the adjustment of droplet size of the dispensate.

8. The invention as set forth in claim 6 in a combination in which each of the dispenser heads comprises a nozzle assembly, including a base member, and a second member, at least one of the base member and second member having a generally cylindrical surface to which the other member sealingly engages irrespective of the particular relative orientation of the two members as accommodated by the cylindrical surface, the members being relatively movable to achieve the desired direction of dispensate outwardly through the second member, the second member carrying a valve having a valve-head, the valve-head providing a means for dividing portions of the stream being dispensed, and the valve being threadedly connected to the second member, providing axial adjustability of the valve and valve-head by which droplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) the adjustment of droplet size of the dispensate.

9. A process for the dispensing of water to provide fire protection to an area larger than would be covered by water dispensed from a single dispensing source, comprising the dispensing of water from a plurality of spaced multi-nozzled dispensing sources;

the said dispensing being such as to provide a plurality of concentric zones of water coverage from each of the sources, at least one of said zones being substantially 360° in extent;

the dispensing further being from a plurality of circumferentially-extending positions at each source for dispensing to each of said zones in a manner for achieving substantially uniform water coverage throughout each of said zones;

the dispensing from said sources being also such as to avoid substantial overlapping in any area which is common to a zone of more than one source, by providing that the zones of water coverage from certain of the multi-nozzled dispensing sources are less than 360° in extent so as to exclude dispensing into areas of the zone to which water is being dispensed thereto from another source.

10. A multi-nozzled dispenser head for a fire protection system to cover an area larger than would be covered by water dispensed from a single nozzle dispenser head, comprising:

the multi-nozzled dispenser head being provided to have a plurality of sets of outlets, and each of the nozzles being provided with adjustable means to change the water droplet size, each of the sets being provided to have a plurality of outlets, the sets of outlets being of a nature such as to dispense water in concentric zones, a lower one of the sets of outlets being generally horizontally directed, and an upper one of the sets of outlets being upwardly directed, the lower set of outlets being arranged and directed so as to dispense water in a pattern substantially 360° in circumferential extent, and the upper set of outlets being arranged and directed such as to restrict dispensing circumferentially so that the zone covered by the water dispensed from the respective upper set of outlets is a selected amount less than 360° so as to exclude dispensing into areas of a zone to which water is being dispensed form another of such heads, the adjustability of droplet size, in combination with the optional less than 360° extent of water dispensing from any nozzle-head, combining to achieve safety protection against different fire-hazard situations by different droplet sizes in various zones of coverage, from the same multi-nozzled dispenser head, in a combination in which the outlets are each provided as a nozzle assembly, including a base member, and a second member, at least one of the base member and second member having a generally spherical surface to which the other member sealingly engages irrespective of the particular relative orientation of the two members as accommodated by the spherical surface, the members being relatively movably to achieve the desired direction of dispensate outwardly through the second member, the second member carrying a valve having a valve-head, the valve-head providing a means for dividing portions of the streams being dispensed, and the valve being threadedly connected to the second member, providing axial adjustability of the valve and valve-head by which droplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) the adjustment of droplet size of the dispensate.

11. A multi-nozzled dispenser head for a fire protection system to cover an area larger than would be covered by water dispensed from a single nozzle dispenser head, comprising:

the multi-nozzled dispenser head being provided to have a plurality of sets of outlets, and each of the nozzles being provided with adjustable means to change the water droplet size, each of the sets being provided to have a plurality of outlets, the sets of outlets being of a nature such as to dispense water in concentric zones, a lower one of the sets of outlets being generally horizontally directed, and an upper one of the sets of outlets being upwardly directed, the lower set of outlets being arranged and directed so as to dispense water in a pattern substantially 360° in circumferential extent, and the upper set of outlets being arranged and directed such as to restrict dispensing circumferentially so that the zone covered by the water dispensed from the respective upper set of outlets is a selected amount less than 360° so as to exclude dispensing into areas of a zone to which water is being dispensed from another of such heads, the adjustability of droplet size, in combination with the optional less than 360° extent of water dispensing from any nozzle-head, combining to achieve safety protection against different fire-hazard situations by different droplet sizes in various zones of coverage, from the same multi-nozzled dispenser head, in a combination in which the outlets are each provided as a nozzle assembly, including a base member, and a second member, at least one of the base member and second member having a generally cylindrical surface to which the other member sealingly engages irrespective of the particular relative orientation of the two members as accommodated by the cylindrical surface, the members being relatively movable to achieve the desired direction of dispensate outwardly through the second member, the second member carrying a valve having a valve-head, the valve-head providing a means for dividing portions of the stream being dispensed, and the valve being threadedly connected to the second member, providing axial adjustability of the valve and valve-head by which droplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) adjustment of droplet size of the dispensate.

12. Apparatus for the dispensing of water to provide fire protection to an area larger than would be covered by water dispensed from a single source, comprising;

a plurality of multi-nozzled dispenser heads;

supply means for supplying water to the multi-nozzled dispenser heads;

the multi-nozzled dispenser heads being supported in spaced relationship;

the multi-nozzled dispenser heads each having a plurality of sets of outlets, each of the sets having a plurality of outlets;

the sets of outlets being of a nature such as to dispense water in concentric zones;

and the outlets of each set being arranged and directed such as to avoid substantial overlapping in any area which is common to a zone which would receive water dispensed from more than one of the multi-nozzled dispenser heads, by providing that the zones of water coverage from certain of the multi-nozzled dispenser heads are less than 360° in extent so as to exclude dispensing into areas of a zone to which water is being dispensed thereto from another of the heads;

in a combination in which the outlets are each provided as a nozzle assembly, including a base member, and a second member, at least one of the base member and second member having a generally spherical surface to which the other member sealingly engages irrespective of the particular relative orientation of the two members as accommodated by the spherical surface, the members being relatively movable to achieve the desired direction of dispensate outwardly through the second member, the second member carrying a valve having a valve-head, the valve-head providing a means for dividing portions of the stream being dispensed, and the valve being threadedly connected to the valve and valve-head by which droplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) the adjustment of droplet size of the dispensate.

13. Apperatus for the dispensing of water to provide fire protection to an area larger than would be covered by water dispensed from a single source, comprising:

a plurality of multi-nozzled dispenser heads;

supply means for supplying water to the multi-nozzled dispenser heads;

the multi-nozzled dispenser heads being supported in spaced relationship;

the multi-nozzled dispenser heads each having a plurality of sets of outlets, each of the sets having a plurality of outlets;

the sets of outlets being of a nature such as to to dispense water in concentric zones;

and the outlets of each set being arranged and directed such as to avoid substantial overlapping in any area which is common to a zone which would recive water dispensed from more than one of the multi-nozzled dispenser heads, by providing that the zones of water coverage from certain of the multi-nozzled dispenser heads are less than 360° in extent so as to exclude dispensing into areas of a zone to which water is being dispensed thereto from another of the heads;

in a combination in which the outlets are each provided as a nozzle assembly, including a base member, and a second member, at least one of the base member and second member having a generally cylindrical surface to which the other member sealingly engages irrespective of the particular relative orientation of the two members as accommodated by the cylindrical surface, the members being relatively movable to achieve the desired direction of dispensate outwardly through the second member, the second member carrying valve having a valve-head, the valve-head providing a means for dividing portions of the stream being dispensed, the valve being threadedly connected to the second member, providing axial adjustability of the valve and valve-head by which droplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) the adjustment of droplet size of the dispensate.

14. A process for the dispensing of water to provide fire protection to an area larger than would be covered by water dispensed from a single dispensing source, comprising the dispensing of water from a plurality of spaced multi-nozzled dispensing sources;

the said dispensing being such as to provide a plurality of concentric zones of water coverage from each of the sources;

the dispensing further being from a plurality of circumferentially-extending positions at each source for dispensing to each of said zones in a manner for achieving substantially uniform water coverage throughout each of said zones;

the dispensing from said sources being also such as to avoid substantial overlapping in any area which is common to a zone of more than one source, by providing that the zones of water coverage from certain of the multi-nozzled dispensing sources are less than 360° in extent so as to exclude dispensing into areas of a zone to which water is being dispensed thereto from another source;

in a combination in which the dispensing sources are each provided as a nozzle assembly, including a base member, and a second member, at least one of the base member and second member having a generally spherical surface to which the other member sealingly engages irrespective of the particular relative orientation of the two members as accommodated by the spherical surface, the members being relatively movable to achieve the desired direction of dispensate outwardly through the second member, the second member carrying a valve having a valve-head, the valve-head providing a means for dividing portions of the stream being dispensed, and the valve being threadedly connected to the second member, providing axial adjustability of the valve and valve-head by which droplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) the adjustment of droplet size of the dispensate.

15. A process for the dispensing of water to provide fire protection to an area larger than would be covered by water dispensed from a single dispensing source, comprising the dispensing of water from a plurality of spaced multi-nozzled dispensing sources;

the said dispensing being such as to provide a plurality of concentric zones of water coverage from each of the sources;

the dispensing further being from a plurality of circumferentially-extending positions at each source for dispensing to each of said zones in a manner for achieving substantially uniform water coverage throughout each of said zones;

the dispensing from said sources being also such as to avoid substantial overlapping any area which is common to a zone of more than one source, by providing that the zones of water coverage from certain of the multi-nozzled dispensing sources are less than 360° in extent so as to exclude dispensing into areas of a zone to which water is being dispensed thereto from another source;

in a combination in which the dispensing sources are each provided as a nozzle assembly, including a base member, and a second member, at least one of the base member and second member having a generally cylindrical surface to which the other member sealingly engages irrespective of the particular relative orientation of the two members as accommodated by the cylindrical surface, the members being relatively movable to achieve the desired direction of dispensate outwardly through the second member, the second member carrying a valve having a valve-head, the valve-head providing a means for dividing portions of the stream being dispensed, and the valve being threadedly connected to the second member, providing axial adjustability of the valve and valve-head by which froplet size of the water being dispensed may be regulated by adjustment of the valve and thus of the spacing of the valve-head and adjacent portions of the second member, thereby providing, in combination as to the nozzle assembly, the plural-advantage characteristics of (a) adjustability of direction of dispensate by adjustment of the relative orientation of the said base member and second member, and (b) adjustability of the nature of the division of the portions of the dispensate stream, and (c) the adjustment of droplet size of the dispensate.

* * * * *